US005406878A

United States Patent [19]

Freeman et al.

[11] Patent Number: 5,406,878

[45] Date of Patent: Apr. 18, 1995

[54] SWASHPLATE ACTUATING DEVICE FOR AXIAL PISTON PUMPS AND MOTORS

[75] Inventors: Phillip L. Freeman, Yorkville; James C. Goade, Morris; Claude H. Werner, Manhattan, all of Ill.

[73] Assignee: Caterpillar Inc., Peoria, Ill.

[21] Appl. No.: 237,513

[22] Filed: May 3, 1994

[51] Int. Cl.[6] ..... F01B 3/00

[52] U.S. Cl. ..... 92/12.2; 91/505; 417/222.1; 417/269

[58] Field of Search ..... 91/505; 417/222.1, 269; 92/12.2

[56] References Cited

U.S. PATENT DOCUMENTS 4,426,195 1/1984 Herbert et al. ..... 417/222
4,508,011 4/1985 Nolden ..... 91/504
4,584,926 4/1986 Beck et al. ..... 417/222.1
4,896,583 1/1990 Lemke ..... 91/505

*Primary Examiner*—Timothy S. Thorpe
*Assistant Examiner*—William J. Wicker
*Attorney, Agent, or Firm*—John W. Grant

[57] ABSTRACT

Transmitting actuating forces from an actuator to a swashplate of an axial piston unit through a pin extending from a lever of the swashplate induces torsional stresses in the lever. The present invention overcomes this problem by securing a lever to a swashplate so that a distal end portion thereof extends into a slot of an actuator. The distal end portion has a cylindrical shaped surface pivotally seated in a mating socket formed in a slide block positioned within the actuator slot. The actuating forces transmitted from the actuator to the lever are thus transmitted in a straight line motion with minimal torsional stresses introduced into the lever.

4 Claims, 2 Drawing Sheets

SWASHPLATE ACTUATING DEVICE FOR AXIAL PISTON PUMPS AND MOTORS

TECHNICAL FIELD

This invention relates generally to variable displacement axial piston pumps and motors and more particularly to a swashplate actuating device for tilting the swashplate relative to a housing for controlling the displacement of the pumps and motors.

BACKGROUND ART

Variable displacement axial piston pumps and motors in which a swashplate is tilted relative to a housing for controlling the displacement of pistons within piston bores of a rotating barrel are well known. Many of such pumps and motors include a lever secured to the swashplate and has a distal end positioned adjacent an actuator mounted on or within the pump housing. Heretofore, the distal end of the lever has been connected to the actuator through a pin extending laterally outwardly for engagement with a slider that interfaces with the actuator so that linear movement of the actuator causes tilting movement of the swashplate.

One of the problems encountered with such arrangements is that transmitting the forces from the actuator to the lever through a pin cantilevered from the lever imparts a twisting force on the lever in addition to the normal actuating forces needed to tilt the swashplate. This complex loading on the lever results in the need for a more robust lever to minimize deflections in the lever. Deflections in the lever can create slight variations in the tilted position of the swashplate relative to the movement of the actuator.

Moreover, the contact area between the cylindrical surface of the pin and the slider is relatively small causing high contact stresses at the mating surfaces which can lead to premature failure due to galling or pitting of the mating surfaces. Finally, the pin type of connection increases the difficulty of assembling the barrel, pistons, swashplate and so forth within the housing of the pump or motor.

Thus, it would be desirable to provide a swashplate actuating mechanism for a variable displacement axial piston pump or motor in which the actuating forces transmitted from the actuator to the lever are in a straight line relationship to minimize torsional loading on the actuator lever. It would also be desirable to provide such actuating mechanism with larger contact surfaces between the mating components to reduce high contact stresses therebetween.

The present invention is directed to overcoming one or more of the problems as set forth above.

DISCLOSURE OF THE INVENTION

In one aspect of the present invention, a swashplate actuating device for an axial piston unit has a housing, a barrel rotatably mounted within the housing about a longitudinal axis and including a plurality of equally spaced circumferentially arranged piston bores, a plurality of pistons individually reciprocatably positioned within the piston bores, and a swashplate tiltably mounted within the housing and having a planer surface engaged by one end of each piston to control the displacement of the pistons within the piston bores. An elongate actuator has opposite end portions slidably positioned within a pair of axially aligned actuating chambers defined in the housing for rectilinear movement therein. The actuator has a transverse slot therein facing the barrel. A slide block is slidably disposed within the slot and has a cylindrical shaped socket therein. An actuating lever secured to the swashplate extends therefrom generally toward the actuator and has a cylindrical shaped surface formed on a distal end portion of the lever and pivotally seated within the socket of the slide.

BEST MODE FOR CARRYING OUT THE INVENTION

Figure 1:
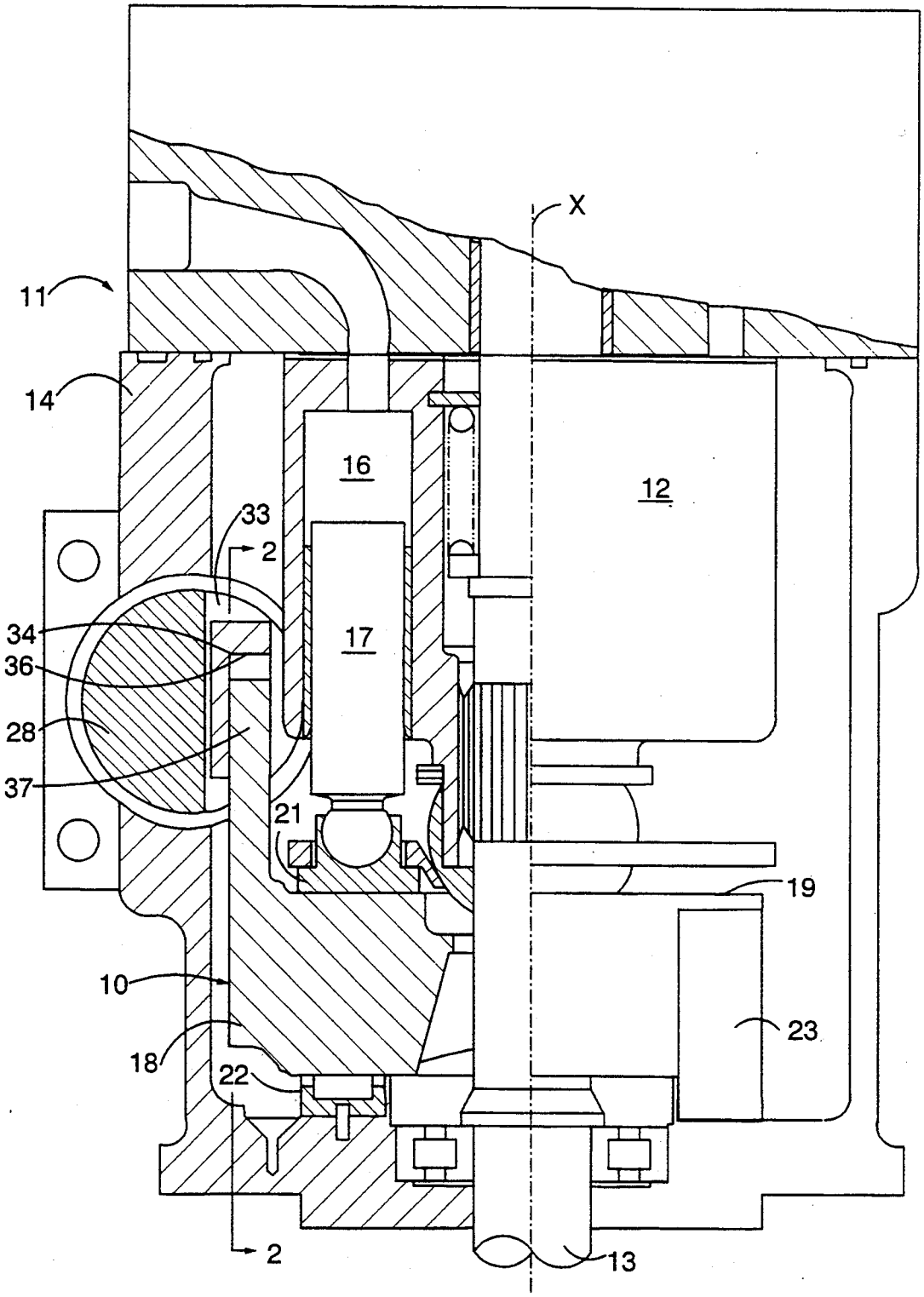
FIG. 1 is a cross-sectional view of an embodiment of the present invention.

A swashplate actuating device 10 is used in a variable displacement axial piston unit 11. The hydraulic unit 11 may be either a pump or a motor and has a rotatable barrel 12 secured to a shaft 13 and which rotates about a central axis X. The barrel 12 is disposed within a housing 14 and has a plurality of equally spaced circumferentially arranged piston bores, one shown at 16. A plurality of pistons, one shown at 17, are individually reciprocatably positioned within the piston bores. A swashplate 18 is positioned within the housing at one end thereof and has a planer surface 19. The ends of the pistons are suitably individually seated in a plurality of piston slippers 21 slidably engaging the planer surface of the swashplate to control or vary the displacement of the pistons within the piston bores. The swashplate 18 is tiltably mounted within the housing 14 by a pair of laterally spaced roller bearing assemblies 22,23.

The swashplate actuating device 10 includes a pair of axially aligned actuating chambers 26,27 10 defined in the housing 14 and an elongate actuator 28 having opposite end portions 29,31 slidably positioned within the actuating chambers 26,27, respectively for rectilinear movement therein. The actuator 28 has a flat surface 32 formed therein facing the inside of the housing and a transverse slot 33 formed in the flat surface facing the barrel 12. A slide block 34 is slidably disposed within the slot 33 and has a cylindrical shaped socket 36 formed therein. An actuating lever 37 is secured to the swashplate and extends therefrom generally toward the actuator 28 and has a cylindrical shaped surface 38 formed on a distal end portion 39 of the lever. The cylindrical shaped surface 38 is pivotally seated within the socket 36 of the slide block 34. The lever 37 in this embodiment is shown as an integral part of the swashplate 10. Alternatively, the actuating lever 37 can be a separate member suitably secured to the swashplate in any well known manner. As shown in FIG. 1, the lever 37 is perpendicular to the planer surface 19 of the swashplate.

INDUSTRIAL APPLICABILITY

Figure 2:
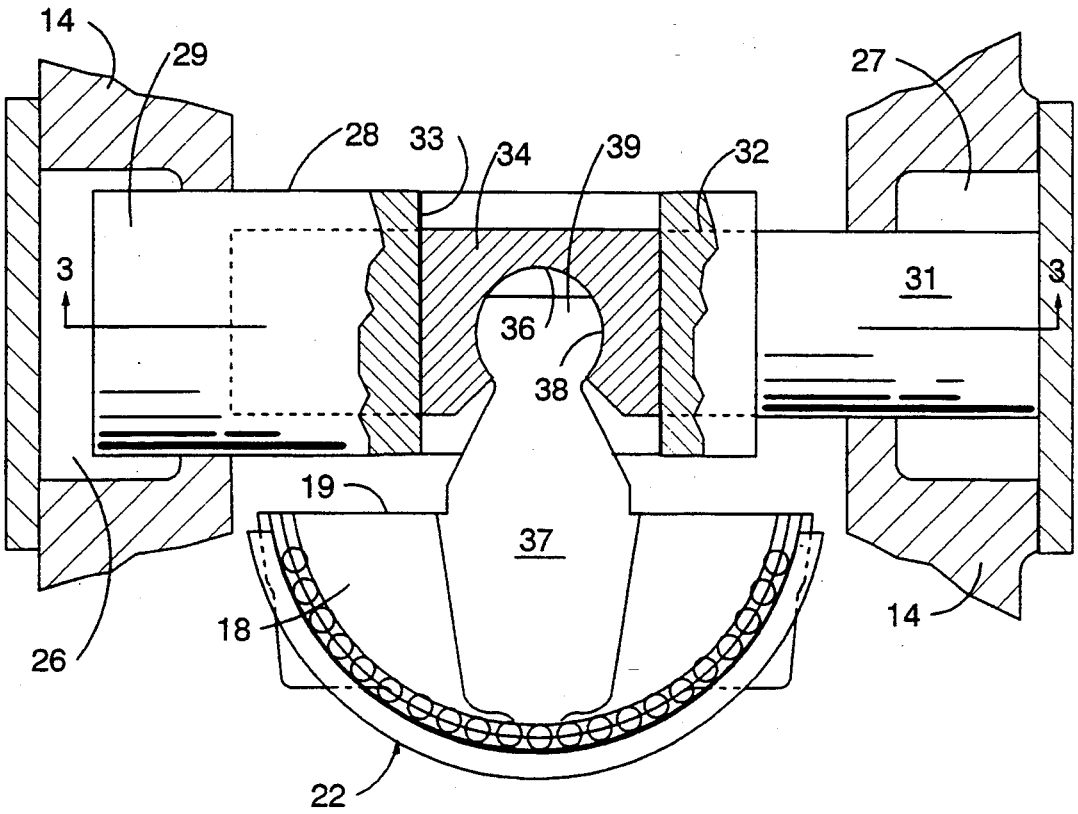
FIG. 2 is a sectional view taken along line 2—2 of FIG. 1.

In use of the axial piston unit 11, the swashplate 18 is tilted or pivoted on the roller bearing assemblies 22,23 to an infinite number of operating positions between a first or neutral position of minimum fluid displacement in which the planer surface 19 is perpendicular to the axis of the barrel and a second position of maximum fluid displacement in which the planer surface is at a maximum displacement angle with respect to the axis of the barrel. Tilting of the swashplate from the neutral position shown is achieved by introducing pressurized fluid into the actuating chamber 27 in the usual manner. This causes rectilinear movement of the actuator 28 leftwardly as viewed in FIG. 2. This leftward movement causes the slide block 34 to move the distal end portion 39 of the lever 37 in a counterclockwise direction about the axis of the bearing assemblies 22,23. The swashplate is returned to the minimum displacement position by suitably introducing pressurized fluid into the actuating chamber 27.

Figure 3:
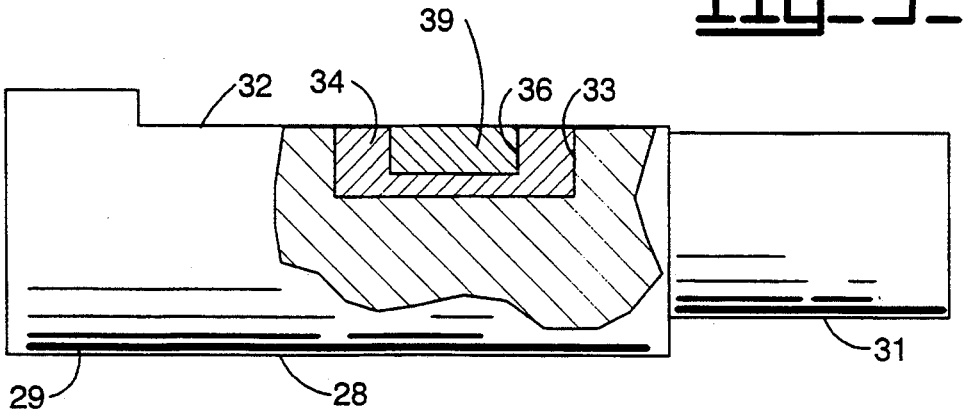
FIG. 3 is a sectional view taken along line 3—3 of FIG. 2.

Referring to FIGS. 1 and 3, it is readily apparent that the actuating force transmitted from the actuator 28 to the lever 37 is in a straight line motion due to the lateral relationship of the lever 37 and the slot 33 in the actuator. This substantially eliminates any tendency of the actuator to impart twisting forces into the lever during actuation. Moreover, by having the distal end portion 39 of the lever directly mating with the slide block 34, the mating external and internal cylindrical surfaces can be made larger to maximize the contact bearing area between the lever and the slide block. Finally, this in-line relationship permits the actuator to be moved close to the barrel thereby minimizing the envelope size of the axial piston unit 11.

Other aspects, objects and advantages of this invention can be obtained from a study of the drawings, disclosure and the appended claims.

We claim:

1. A swashplate actuating device for an axial piston unit having a housing, a barrel rotatably mounted within the housing about a longitudinal axis and having a plurality of equally spaced circumferentially arranged piston bores, a plurality of pistons individually reciprocatably positioned within the piston bores, and a swashplate tiltably mounted within the housing and having a planer surface engaged by one end of each piston to control the displacement of the pistons within the piston bores; comprising a pair of axially aligned actuating chambers defined in the housing;

an elongate actuator having opposite end portions slidably positioned within the actuating chambers for rectilinear movement therein, the actuator having a transverse slot therein facing the barrel;

a slide block slidably disposed within the slot in the actuator and having a cylindrical shaped socket therein; and an actuating lever secured to the swashplate and extending therefrom generally toward the actuator and having a cylindrical shaped surface formed on a distal end portion of the lever and being pivotally seated within the socket of the slide block.

2. The swashplate actuating device of claim 1 wherein the actuating lever is perpendicular to the planer surface.

3. The swashplate actuating device of claim 1 wherein the actuating lever is formed as an integral part of the swashplate.

4. The swashplate actuating device of claim 1 wherein the actuator has a flat surface formed thereon facing the inside of the housing, the slot in the actuator being recessed from the flat surface.

* * * * *